US011592777B2

(12) United States Patent
Hamada

(10) Patent No.: US 11,592,777 B2
(45) Date of Patent: Feb. 28, 2023

(54) IMAGE FORMING APPARATUS

(71) Applicant: KYOCERA Document Solutions Inc., Osaka (JP)

(72) Inventor: Toshiyuki Hamada, Osaka (JP)

(73) Assignee: KYOCERA Document Solutions Inc., Osaka (JP)

( * ) Notice: Subject to any disclaimer, the term of this patent is extended or adjusted under 35 U.S.C. 154(b) by 0 days.

(21) Appl. No.: 17/675,833

(22) Filed: Feb. 18, 2022

(65) Prior Publication Data

US 2022/0269211 A1 Aug. 25, 2022

(30) Foreign Application Priority Data

Feb. 22, 2021 (JP) ..... JP2021-026239

(51) Int. Cl.
*G03G 15/00* (2006.01)
*G03G 15/20* (2006.01)

(52) U.S. Cl.
CPC ..... *G03G 15/6573* (2013.01); *G03G 15/2028* (2013.01); *G03G 2215/00417* (2013.01); *G03G 2215/00679* (2013.01)

(58) Field of Classification Search
CPC ..... G03G 15/6573; G03G 2215/00417; G03G 2215/00679
See application file for complete search history.

(56) References Cited

U.S. PATENT DOCUMENTS 9,856,100 B2 * 1/2018 Tanaka ..... B65H 5/062
2008/0145124 A1 * 6/2008 Ruiz ..... G03G 15/6573 399/406

FOREIGN PATENT DOCUMENTS

JP 2007-331931 A 12/2007

* cited by examiner

*Primary Examiner* — Susan S Lee
(74) *Attorney, Agent, or Firm* — Studebaker & Brackett PC

(57) ABSTRACT

An image forming apparatus includes a fixing device, a conveyance rollers pair, a curved path and a first guide roller. The fixing device fixes a toner image on a sheet. The conveyance rollers pair conveys the sheet on which the toner image is fixed by the fixing device. The curved path is provided between the fixing device and the conveyance rollers pair, and the sheet is conveyed along the curved path with a toner image fixed surface facing an inner peripheral side of the curved path. The first guide roller is shiftable between a guide position protruding in the curved path from the inner peripheral side and the inner peripheral side. When the sheet is conveyed along the curved path, the first guide roller is pushed by the sheet while rotating following the sheet and then is shifted from the guide position to the inner peripheral side.

10 Claims, 8 Drawing Sheets

IMAGE FORMING APPARATUS

INCORPORATION BY REFERENCE

This application is based on and claims the benefit of priority from Japanese patent application No. 2021-026239 filed on Feb. 22, 2021, which is incorporated by reference in its entirety.

BACKGROUND

The present disclosure relates to an image forming apparatus provided with a guide which guides a sheet on which a toner image is fixed.

With the downsizing of an image forming apparatus, a conveyance path for a sheet is sometimes formed so as to be shortened or curved. The conveyance path is conventionally formed between a pair of guides. Further, on the conveyance path, conveyance rollers pairs are disposed at predetermined intervals.

When the conveyance path is shortened and the interval between the conveyance rollers pairs becomes narrow, the sheet is conveyed while held between the adjacent conveyance rollers pairs. Then, in order to properly droop or stretch the sheet between the adjacent conveyance rollers pairs, it is necessary to adjust the rotational speed of the conveyance rollers pairs. Further, for example, when the conveyance path between the fixing device and the discharge device is curved, the toner fixed surface of the sheet comes into contact with the guide, and the toner may adhere to the guide.

Then, the image forming apparatus may be provided with a guide member which guides the sheet discharged from the fixing device. The guide member has a columnar roller configured such that a part of the outer circumferential surface of the roller comes into contact with the toner fixed surface of the sheet.

However, in the above image forming apparatus, when a high pressure is applied to the sheet from the roller (for example, a case where the sheet is a thick paper), the fixed toner image may adhere to the roller. Then, various problem, such as a sheet jamming owing to the deterioration of the guide performance of the roller or an occurrence of white streak on the image owing to the adhered toner, may be generated.

SUMMARY

In accordance with an aspect of the present disclosure, an image forming apparatus includes a fixing device, a conveyance rollers pair, a curved path and a first guide roller. The fixing device fixes a toner image on a sheet. The conveyance rollers pair conveys the sheet on which the toner image is fixed by the fixing device. The curved path is provided between the fixing device and the conveyance rollers pair, and the sheet is conveyed along the curved path with a toner image fixed surface facing an inner peripheral side of the curved path. The first guide roller is shiftable between a guide position protruding in the curved path from the inner peripheral side and the inner peripheral side. When the sheet is conveyed along the curved path, the first guide roller is pushed by the sheet while rotating following the sheet and then is shifted from the guide position to the inner peripheral side.

The other features and advantages of the present disclosure will become more apparent from the following description. In the detailed description, reference is made to the accompanying drawings, and preferred embodiments of the present disclosure are shown by way of example in the accompanying drawings.

DETAILED DESCRIPTION

Hereinafter, with reference to the attached drawings, an image forming apparatus according to one embodiment in the present disclosure will be described.

Figure 1:
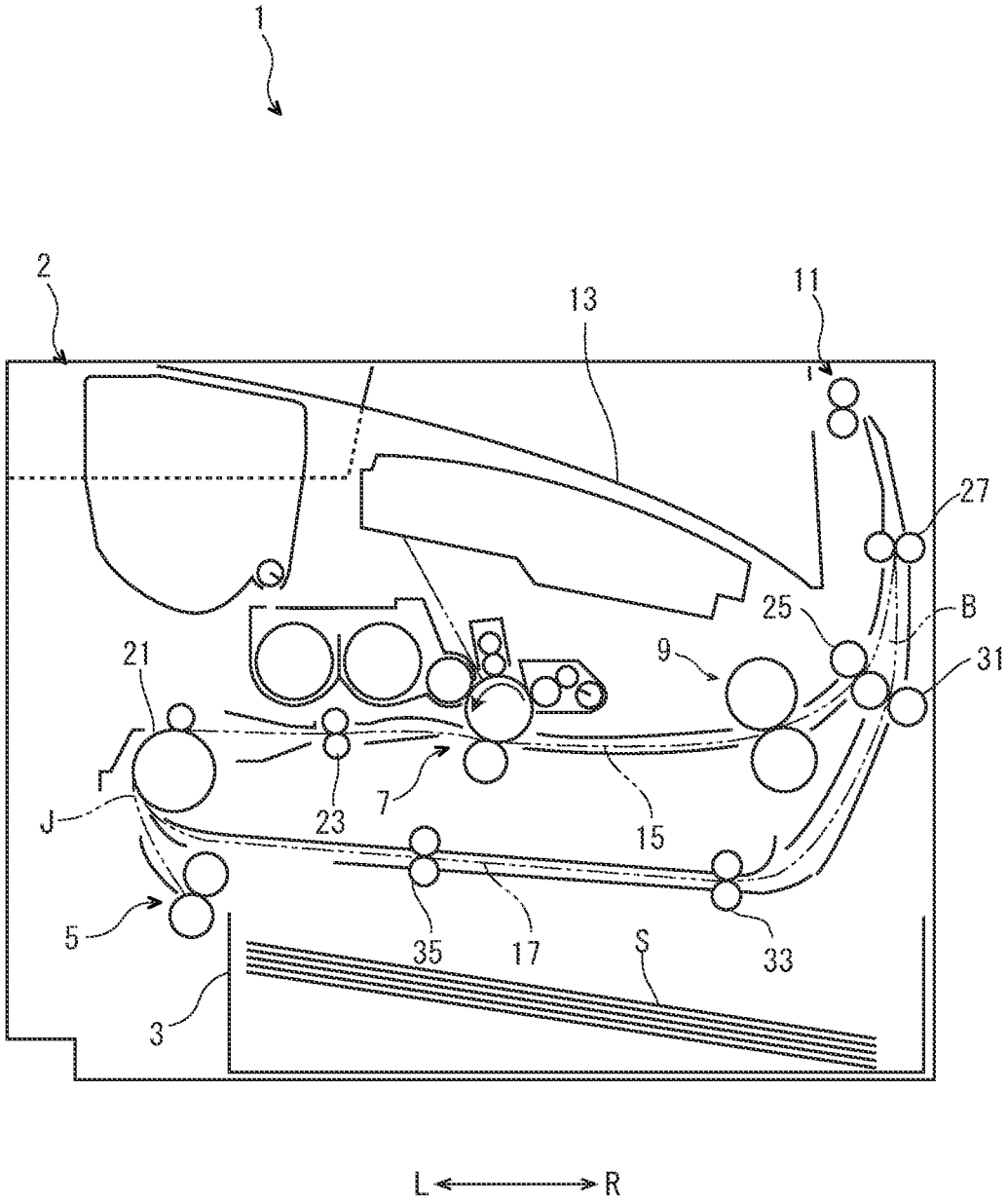
FIG. 1 is a front view schematically showing an inner structure of an image forming apparatus according to one embodiment of the present disclosure.

First, with reference to FIG. 1, an entire structure of the image forming apparatus 1 will be described. FIG. 1 is a front view schematically showing an inner structure of the image forming apparatus 1. Hereinafter, the front side of the paper plane on which FIG. 1 is drawn is defined as a front side of the image forming apparatus 1. In each drawing, L and R indicate the left side and the right side of the image forming apparatus 1.

The apparatus main body 2 of the image forming apparatus 1 includes a sheet feeding cassette 3 in which a sheet S is stored, a sheet feeding device 5 which feeds the sheet S from the sheet feeding cassette 3, an image forming part 7 which forms a toner image on the sheet S, a fixing device 9 which fixes the toner image on the sheet S, and a sheet discharge rollers pair 11 which discharges the sheet S. On the upper surface of the apparatus main body 2, a discharge tray 13 on which the discharged sheets S are stacked is provided.

In the apparatus main body 2, a main conveyance path 15 and a duplex printing path 17 along which the sheet S is conveyed are formed. The main conveyance path 15 is formed so as to be curved upward from the sheet feeding device 5, extended approximately linearly along the horizontal direction through the image forming part 7 and the fixing device 9, and then curved upward toward the discharge rollers pair 11. The duplex printing path 17 is formed so as to be branched from a branch point B between the fixing device 9 and the discharge rollers pair 11 on the main conveyance path 15 and joined to the main conveyance path 15 at a joining point J between the sheet feeding deice 5 and the image forming part 7. In the following description, a direction along the main conveyance path 15 from the sheet feeding device 5 to the discharge rollers pair 11 and a direction along the duplex printing path 17 from the branch point B to the joining point J are referred to as a conveyance direction for the sheet S. A direction perpendicular to the conveyance direction is refereed to as a width direction for the sheet S. Further, the upstream side and the downstream side indicate the upstream side and the downstream side in the conveyance direction for the sheet S.

On the main conveyance path 15, a first intermediate rollers pair 21, a registration rollers pair 23, a fixing discharge rollers pair 25, and a second intermediate rollers pair 27 are provided in the order from the upstream side. The first intermediate rollers pair 21 is disposed on the curved path of the main conveyance path 15 between the sheet feeding device 5 and the image forming part 7. The registration rollers pair 23 is disposed between the image forming part 7 and the joining point J. The fixing discharge rollers pair 25 is disposed between the fixing device 9 and the branch point B. The second intermediate rollers pair 27 is disposed between the branch point B and the discharge rollers pair 11. On the duplex printing path 17, a duplex printing conveyance rollers pair 31, a third intermediate rollers pair 33 and a fourth intermediate rollers pair 35 are provided in the order from the upstream side.

Next, an image forming operation will be described briefly. The sheet fed from the sheet feeding cassette 3 to the main conveyance path 15 by the sheet feeding device 5 is conveyed along the main conveyance path 15 by the first intermediate rollers pair 21, and the skew of the sheet is corrected by the registration rollers pair 23. Thereafter, the sheet S is conveyed to the image forming part 7, and a toner image is formed on one surface (the front surface) of the sheet S by the image forming part 7. Then, the sheet S in which the toner image is formed on one surface is conveyed to the fixing device 9 along the main conveyance path 15, and the toner image is fixed on one surface of the sheet S by the fixing device 9. The sheet S in which the toner image is fixed on one surface is conveyed along the main conveyance path 15 by the fixing discharge rollers pair 25 and the second intermediate rollers pair 27, and is discharged by the discharge rollers pair 11. The discharged sheet S is stacked on the discharge tray 13.

In a case of the duplex printing, the sheet S in which the toner image is fixed on one surface by the fixing device 9 is switched back by the second intermediate rollers pair 27, and is conveyed along the duplex printing path 17 from the main conveyance path 15 at the branch point B. Then, the sheet S is conveyed along the duplex printing path 17 by the duplex printing conveyance rollers pair 31, the third intermediate rollers pair 33 and the fourth intermediate rollers pair 35, and is joined to the main conveyance path 15 at the joining point J. When the sheet S is switched back and is conveyed along the duplex printing path 17 as described above, the front and back surfaces of the sheet S are inverted. Thereafter, the sheet S is conveyed along the main conveyance path 15 as described above, a toner image is formed on the other surface (the back surface) of the sheet S by the image forming part 7, and then the toner image is fixed on the other surface of the sheet S by the fixing device 9. Thereafter, the sheet S is conveyed by the fixing discharge rollers pair 25 and the second intermediate rollers pair 27, and then is discharged by the discharge rollers pair 11.

Figure 2:
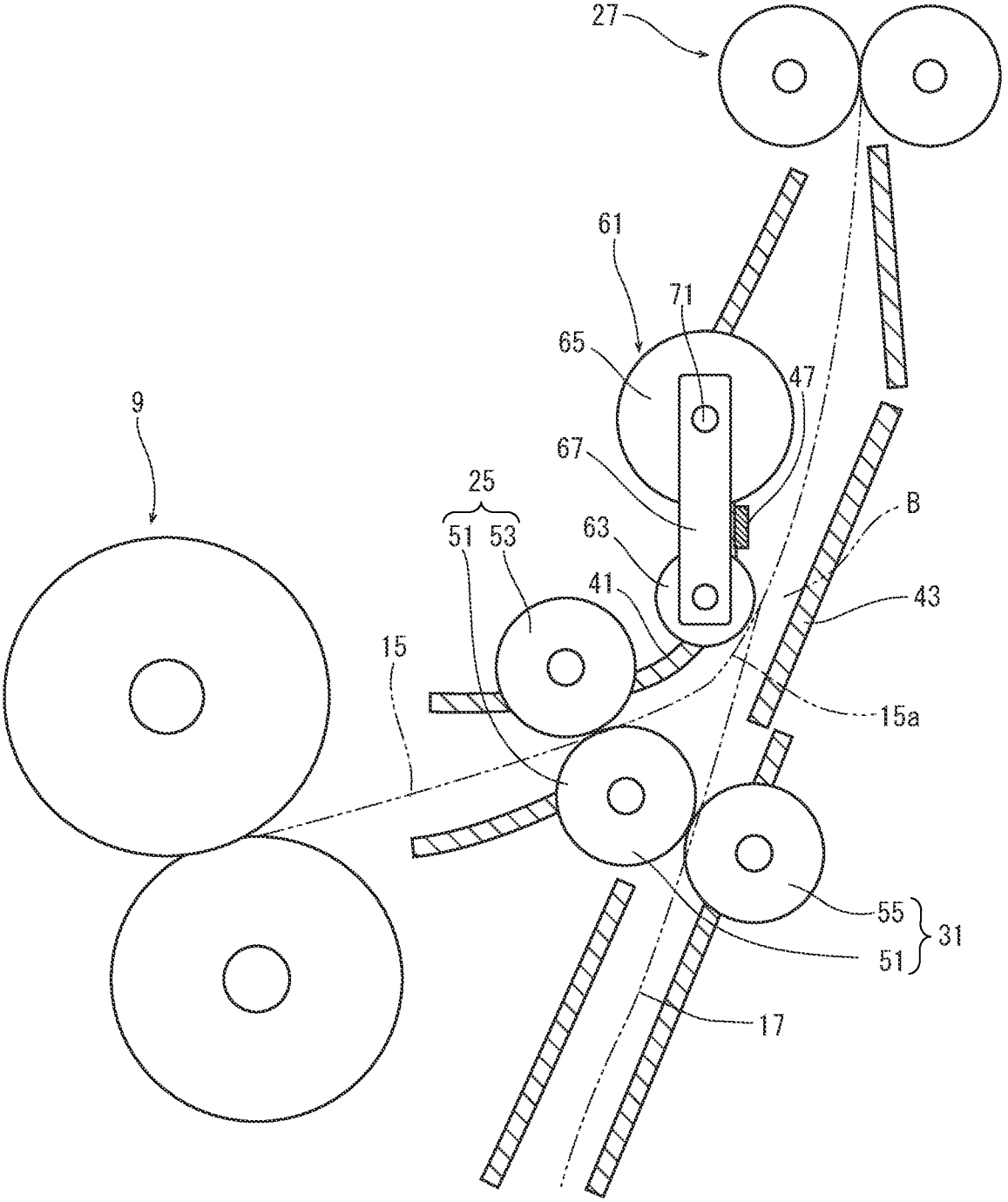
FIG. 2 is a front view showing a conveyance path between a fixing device and an intermediate rollers pair, in the image forming apparatus according to the embodiment of the present disclosure.

Next, with reference to FIG. 2, the main conveyance path 15 between the fixing device 9 and the second intermediate rollers pair 27 and the duplex printing path 17 will be described. FIG. 2 is a front view schematically showing the main conveyance path 15 between the fixing device 9 and the second intermediate conveyance rollers pair 27. The second intermediate conveyance rollers pair 27 is an example of a conveyance rollers pair in the present disclosure.

As described above, the main conveyance path 15 between the fixing device 9 and the second intermediate rollers pair 27 is formed so as to be curved upward. In detail, it extends rightward along the horizontal direction from the fixing device 9, is curved upward in an arc shape, and then extends upward toward the second intermediate rollers pair 27. As described, the main conveyance path 15 contains an arc-shaped curved path 15*a* from the fixing device 9 to the second intermediate rollers pair 27. The curved path 15*a* is formed between an inner guide 41 disposed on the inner peripheral side of the curved path 15*a* and an outer guide 43 disposed on the outer peripheral side of the curved path 15*a*. The inner guide 41 is formed in an upwardly curved shape. The outer guide 43 is formed in a straight shape along the duplex printing path 17. The sheet S passed through the fixing device 9 is conveyed in a posture where the surface on which the toner image is fixed (the toner image fixed surface) faces the inner peripheral side of the curved path 15*a*, that is, the inner guide 41.

The fixing discharge rollers pair 25 includes a discharge drive roller 51 and a discharge driven roller 53. When the discharge drive roller 51 is driven to be rotated in one direction, the discharge driven roller 53 is driven to be rotated to convey the sheet S from the fixing device 9 to the branch point B. The duplex printing conveyance rollers pair 31 includes the discharge drive roller 51 and a duplex printing driven roller 55. When the discharge drive roller 51 is driven to be rotated, the duplex printing driven roller 55 is driven to be rotated to convey the sheet from the branch point B to the duplex printing path 17. As described above, the discharge drive roller 51 is used in both the fixing discharge rollers pair 25 and the duplex printing conveyance rollers pair 31.

Figure 3A:
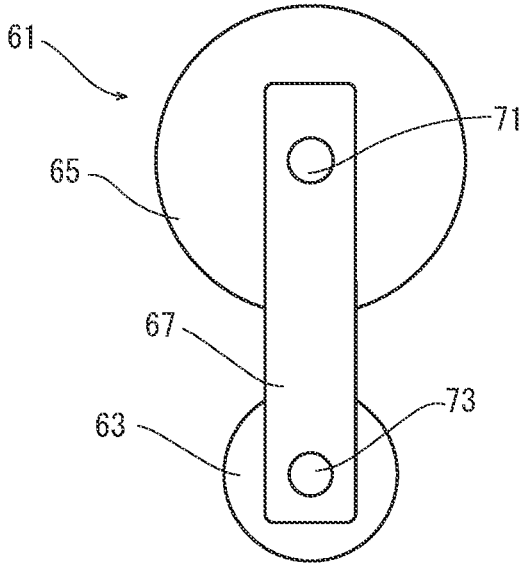
FIG. 3A is a view showing a guide member (a first guide roller and a second guide roller), when viewed from the axial directions of the rollers, in the image forming apparatus according to the embodiment of the present disclosure.
Figure 3B:
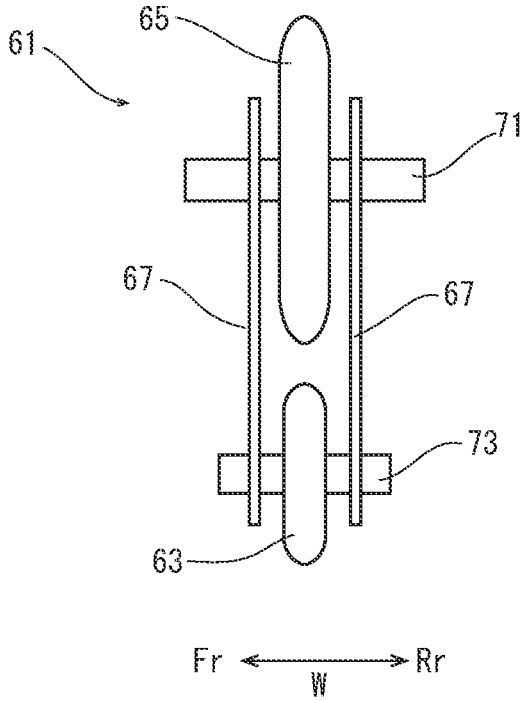
FIG. 3B is a view showing the guide member (the first guide roller and the second guide roller), when viewed from the directions perpendicular to the axial directions of the rollers, in the image forming apparatus according to the embodiment of the present disclosure.
Figure 4:
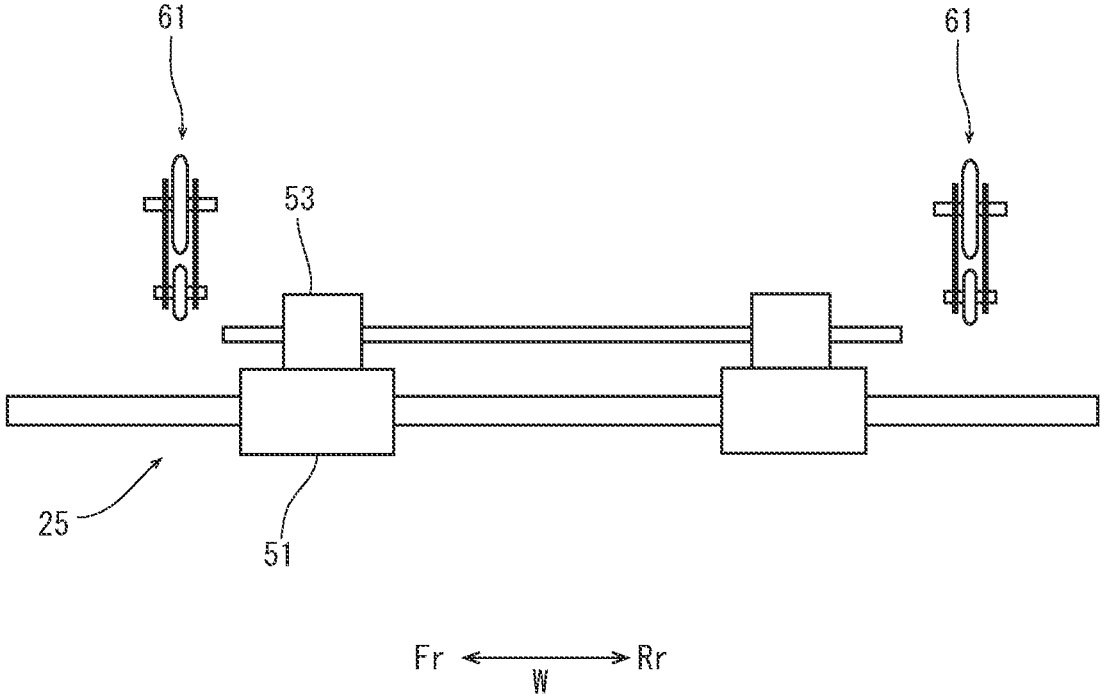
FIG. 4 is a view showing a positional relationship between the guide member and a fixing discharge rollers pair in a width direction, in the image forming apparatus according to one embodiment of the present disclosure.

On the inner peripheral side of the curved path 15*a*, two guide members 61 are supported. The guide member 61 will be described with reference to FIG. 3A, FIG. 3B and FIG. 4 in addition to FIG. 2. FIG. 3A and FIG. 3B are views showing the guide member 61, viewed from the axial direction of each roller and from the direction perpendicular to the axial direction, respectively. FIG. 4 is a view showing the two guide members 61 in the width direction.

As shown in FIG. 3A and FIG. 3B, the guide member 61 includes a first guide roller 63, a second guide roller 65, and two coupling plates 67 coupling the guide rollers 63 and 65.

The coupling plate 67 is a long plate-shaped member. The upper end portions of the two coupling plates 67 are rotatably supported by a fixing side supporting shaft 71 provided in the inner guide 41. The lower end portions of the two coupling plates 67 are coupled with each other by a moving side supporting shaft 73.

The first guide roller 63 is a disk-shaped member having a relatively thin thickness in the width direction. The outer circumferential surface of the first guide roller 63 has a circular arc-shaped cross section. The first guide roller 63 is supported by the moving side supporting shaft 73 in a rotatable manner between the two coupling plates 67. The second guide roller 65 is a disk-shaped member having the same thickness in the width direction as that of the first guide roller 63. The outer circumferential surface of the second guide roller 65 has a circular arc-shaped cross section. The second guide roller 65 is supported by the fixing side supporting shaft 71 in a rotatable manner between the two coupling plates 67 between the two coupling plates 67. In this embodiment, the diameter of the second guide roller 65 is larger than the diameter of the first guide roller 63.

As shown in FIG. 2, the fixing side supporting shaft 71 is supported by the upper end portion of the inner guide 41. Thereby, the coupling plates 67 are hung down from the fixing side supporting shaft 71 along the vertical direction owing to their weights. At this time, a part of the first guide roller 63 protrudes in the curved path 15*a* from the inner peripheral side. The position of the first guide roller 63 shown in FIG. 2 is referred to as a guide position. Preferably, a part of the first guide roller 63 protrudes in the apex portion of the curved path 15*a*. Further, a part of the second guide roller 65 protrudes in the main conveyance path 15 from the inner peripheral side on the downstream side of the first guide roller 63.

The coupling plates 67 are turnable around the fixing side supporting shaft 71 in a direction toward the main conveyance path 15 and in the counter direction retreating from the main conveyance path 15 toward the inner peripheral side. The inner guide 41 is provided with a restriction piece 47 which restricts the turning of the coupling plates 67 in the direction toward the main conveyance path 15 from a posture where the coupling plates 67 hang down along the vertical direction from the fixing side supporting shaft 71. This restricts the shift of the first guide roller 63 from the guide position toward the curved path 15*a*.

As shown in FIG. 4, the guide members 61 are disposed outside the fixing discharge rollers pair 25 in the width direction W.

The sheet guiding operation of the guide member 61 having the above-described structure will be described with reference to FIG. 5A to FIG. 7B. FIG. 5A to FIG. 7B are front views schematically showing the sheet being passed through the conveyance path 15 between the fixing device 9 and the second intermediate rollers pair 27. In this embodiment, the operation of the guide member 61 at the time of the duplex printing will be described.

Figure 5A:
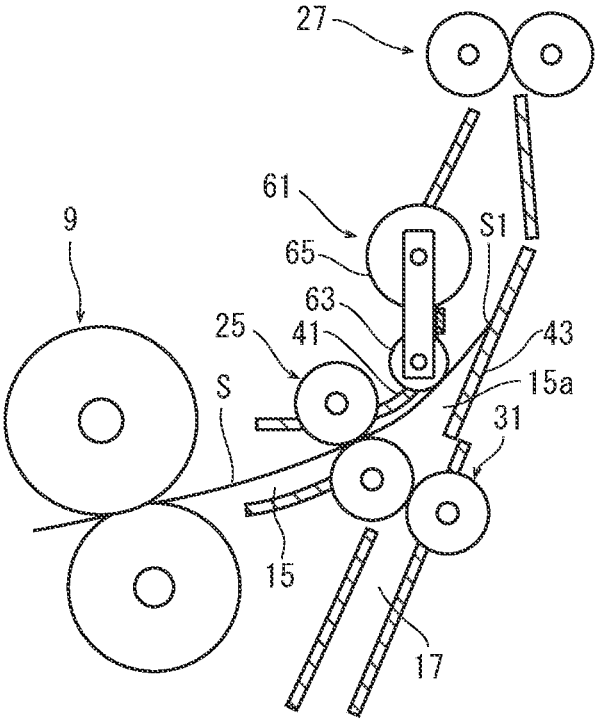
FIG. 5A is a front view schematically showing a sheet being conveyed along the conveyance path between the fixing device and the intermediate rollers pair (after the leading edge of the sheet is passed through the fixing discharge rollers pair), in the image forming apparatus according to the embodiment of the present disclosure.

As shown in FIG. 5A, the sheet S is conveyed toward the second intermediate rollers pair 27 along the main conveyance path 15 by the fixing discharge rollers pair 25 (the discharge drive roller 51 and the discharge driven roller 53) after passed through the fixing device 9. As described above, the sheet S is conveyed in the posture where the toner image fixed surface faces the inner peripheral side of the curved path 15*a*. At this time, the sheet S comes into contact with the first guide roller 63 to be guided toward the outer guide 43, and the leading edge S1 of the sheet S comes into contact with the outer guide 43. The first guide roller 63 is rotated by the contact with the sheet S and is also pushed by the sheet S. As a result, the coupling plates 67 is turned toward the inner peripheral side, and then the first guide roller 63 is slightly shifted toward the inner peripheral side.

Figure 5B:
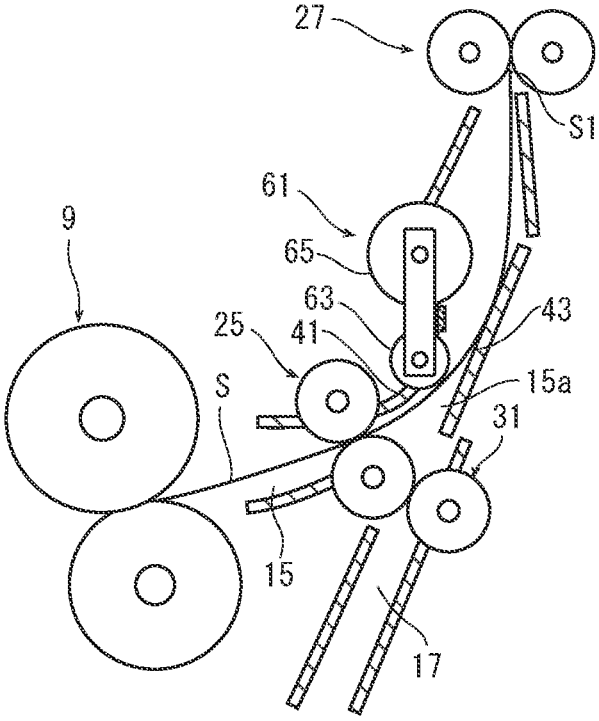
FIG. 5B is a front view schematically showing the sheet being conveyed along the conveyance path between the fixing device and the intermediate rollers pair (at a time when the leading edge of the sheet reaches the intermediate rollers pair), in the image forming apparatus according to the embodiment of the present disclosure.

After that, as shown in FIG. 5B, the sheet S is conveyed along the outer guide 43 toward the second intermediate rollers pair 27. In a state where the leading edge S1 of the sheet S reaches the second intermediate rollers pair 27, the sheet S is deformed so as to be curved toward the outer peripheral side of the curved path 15*a*.

Figure 6A:
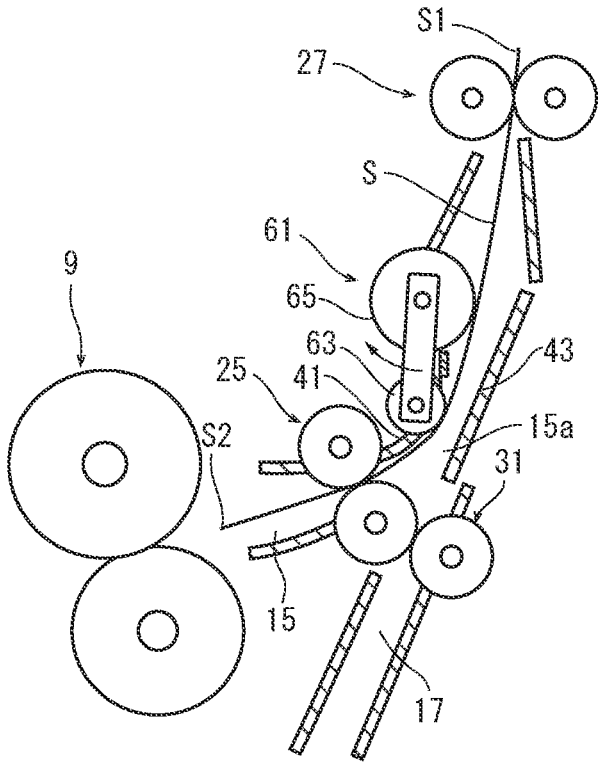
FIG. 6A is a front view schematically showing the sheet being conveyed along the conveyance path between the fixing device and the intermediate rollers pair (in a state where the leading end portion of the sheet is held by the intermediate rollers pair), in the image forming apparatus according to the embodiment of the present disclosure.

As shown in FIG. 6A, when the leading edge S1 of the sheet S is passed through the second intermediate rollers pair 27 and the tail edge S2 of the sheet S is passed through the fixing device 9, the sheet S is conveyed while held by the second intermediate rollers pair 27 and the fixing discharge rollers pair 25. At this time, the second intermediate rollers pair 27 is rotated at a speed faster than the fixing discharge rollers pair 25 so that the sheet S is not deformed too much. As a result, the sheet S is tensed between the two rollers pairs 25 and 27, and the inner peripheral side surface, that is, the toner image fixed surface of the sheet S is guided in contact with the first guide roller 63 and the second guide roller 65. The first guide roller 63 and the second guide roller 65 are rotated as the sheet S is conveyed, and are pushed by the sheet S. Then, the first guide roller 63 is shifted to the inner peripheral side (see the arrow in FIG. 6A) to release the pressure applied to the first guide roller 63 from the sheet S.

Figure 6B:
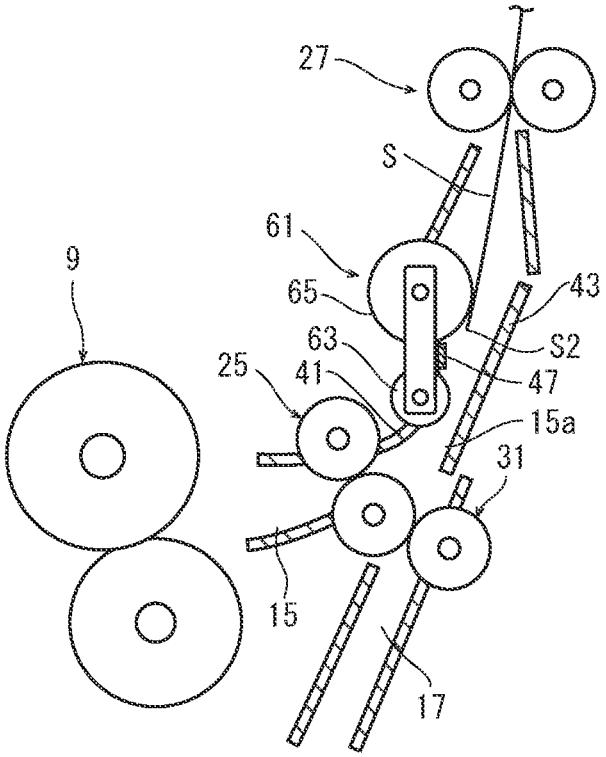
FIG. 6B is a front view schematically showing the sheet being conveyed along the conveyance path between the fixing device and the intermediate rollers pair (at a time when the tail edge of the sheet is passed through the fixing discharge rollers pair), in the image forming apparatus according to the embodiment of the present disclosure.

Then, as shown in FIG. 6B, when the tail edge S2 of the sheet S is passed through the fixing discharge rollers pair 25, the tail end portion of the sheet S is guided by the second guide roller 65. The coupling plates 67 are turned by their own weights until coming into contact with the restriction piece 47, and the first guide roller 63 returns to the guide position.

Figure 7A:
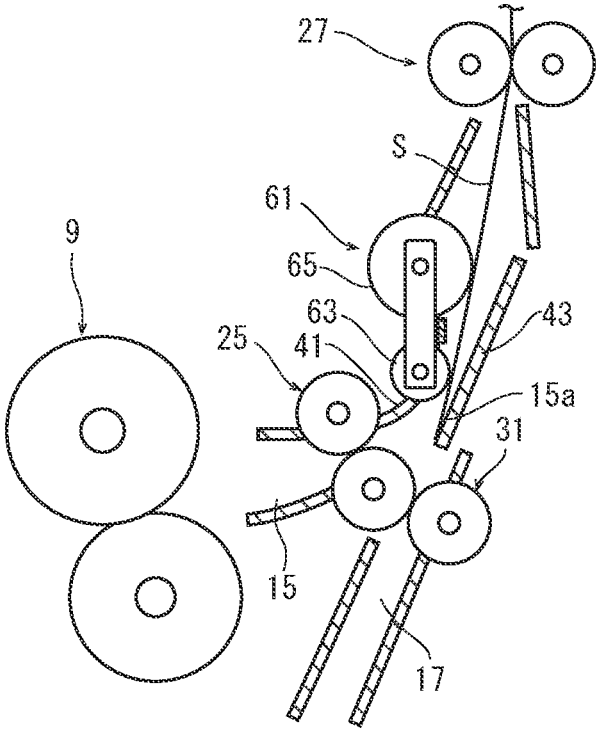
FIG. 7A is a front view schematically showing the sheet being conveyed along the conveyance path between the fixing device and the intermediate rollers pair (at a time when the intermediate rollers pair is rotated in a counter direction), in the image forming apparatus according to the embodiment of the present disclosure.

Thereafter, as shown in FIG. 7A, the second intermediate rollers pair 27 is reversely rotated at a predetermined timing. Thus, the conveyance direction of the sheet S is inversed, and the leading end portion of the sheet S is guided toward the duplex printing path 17 by the second guide roller 65.

Then, the sheet S is guided by the first guide roller 63 and the outer guide 43 to the duplex printing path 17. At this time, the first guide roller 63 is shifted from the guide position to the inner peripheral side to release the pressure applied to the first guide roller 63 from the paper S.

Figure 7B:
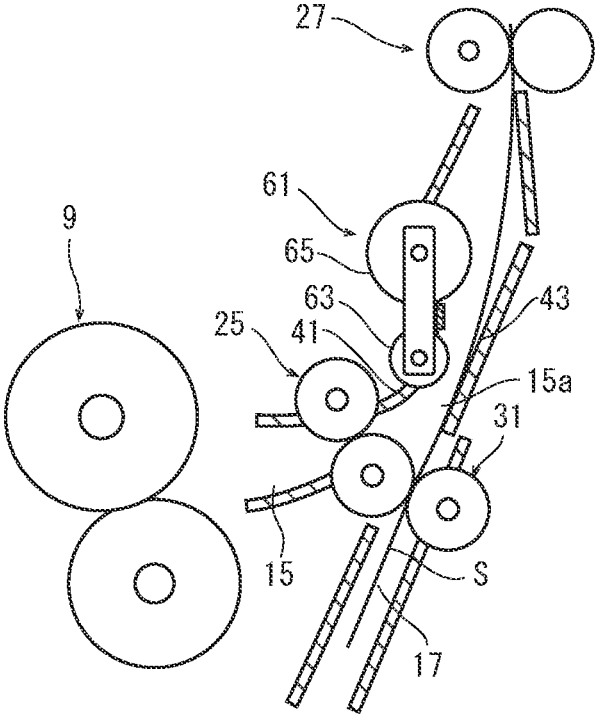
FIG. 7B is a front view schematically showing the sheet being conveyed along the conveyance path between the fixing device and the intermediate rollers pair (at a time when the leading edge of the sheet enters a duplex printing path), in the image forming apparatus according to the embodiment of the present disclosure.

Thereafter, as shown in FIG. 7B, the leading end portion of the sheet S is guided by the outer guide 43, and is conveyed to the duplex printing path 17 by the duplex printing conveyance rollers pair 31 (the discharge drive roller 51 and the duplex printing driven roller 55). At this time, the sheet S is held between the duplex printing conveyance rollers pair 31 and the second intermediate rollers pair 27. Because the duplex printing conveyance rollers pair 31 is rotated at a speed slower than that of the second intermediate rollers pair 27, the sheet S is deformed toward the outer peripheral side between the rollers pairs 31 and 27.

As described above, in the image forming apparatus 1 of the present disclosure, when the sheet S on which the toner image has been fixed is conveyed along the curved path 15*a*, the toner image fixed surface of the sheet S is guided by the first guide roller 63 and the second guide roller 65. Further, the first guide roller 63 is shiftable from the curved path 15*a* to the inner peripheral side. In the above manner, in the curved path 15*a* where the pressure is easily applied to the first guide roller 63 from the sheet S, the pressure applied to the first guide roller 63 from the sheet S can be released so that the adhesion of the toner of the toner image fixed surface to the first guide roller 63 can be prevented. Therefore, the curved path 15*a* can be formed on the downstream side of the fixing device 9, so that the image forming apparatus 1 can be downsized.

The first guide roller 63 is maintained at the guide position by the weights of the connecting plates 67 and itself. Therefore, even when a very weak pressure is applied to the first guide roller 63, the first guide roller 63 is shifted so as to be retreated from the guide position, so that it becomes possible to release the pressure applied to the first guide roller 63 from the sheet S surely. Accordingly, the separation of the toner image from the sheet S can be more surely prevented. Further, because the coupling plates 67 come into contact with the restriction piece 47, it becomes possible to restrict the excessive protruding of the first guide roller 63 into the curved path 15*a*.

Further, by providing the second guide roller 65 in addition to the first guide roller 63, it becomes possible to smoothly guide the sheet S from the main conveyance path 15 to the duplex printing path 17 at the time of the duplex printing.

Figure 8A:
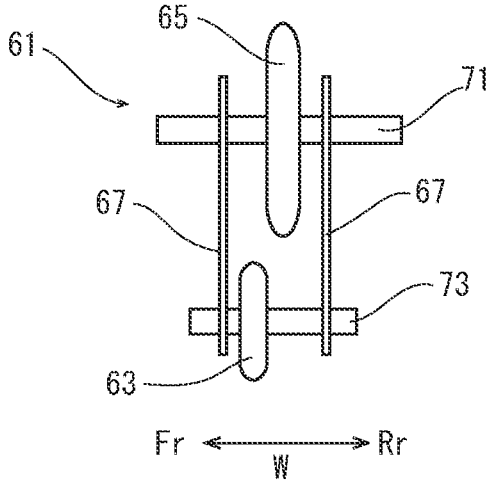
FIG. 8A is a view showing a first modified example of the guide member in the image forming apparatus according to the embodiment of the present disclosure.

Next, with reference to FIG. 8A to FIG. 9C, the modified examples of the present disclosure will be described. FIG. 8A shows the first modified example, and FIG. 8B and FIG. 8C show the second modified example.

In the first modified example shown in FIG. 8A, the first guide roller 63 and the second guide roller 65 are disposed to be shifted in the width direction Y (the axial directions of the supporting shafts 71 and 73).

The area where the first guide roller 63 and the second guide roller 65 come into contact with the toner image fixed surface of the sheet S is narrow, and the pressure applied to each of them from the sheet S is small, but the toner may be separated from the toner image fixed surface by the contact with each roller. According to the first modified example, because the positions where the first guide roller 63 and the second guide roller 65 comes into contact with the toner image fixed surface are shifted in the width direction Y, the toner separation positions on the toner image fixed surface are dispersed, thereby reducing the level of image defects.

Figure 8B:
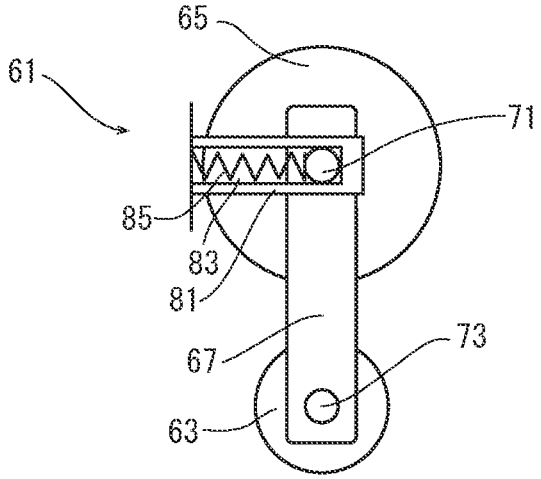
FIG. 8B is a view showing a second modified example of the guide member, viewed from an axial direction of a supporting shaft, in the image forming apparatus according to the embodiment of the present disclosure.
Figure 8C:
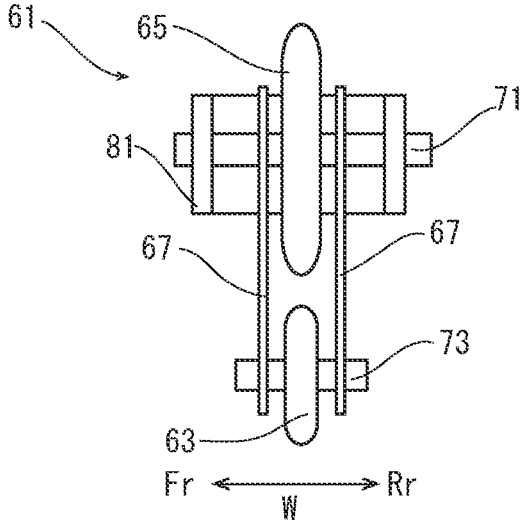
FIG. 8C is a view showing the second modified example of the guide member, viewed from the direction perpendicular to the axial direction of the supporting shaft, in the image forming apparatus according to the embodiment of the present disclosure.

In the second modified example shown in FIG. 8B and FIG. 8C, the fixing side supporting shaft 71 is supported so as to be shifted from the main conveyance path 15 to the inner peripheral side. That is, both end portions of the fixing side supporting shaft 71 are supported in a movable manner along the horizontal direction by support members 81 provided on the apparatus main body 3. A groove hole 83 is formed in the support member 81 along the horizontal direction. The end portions of the fixing side supporting shaft 71 are inserted into the groove holes 83 of the support members 81. Further, in the groove hole 83, a coil spring 85 which biases the end portion of the fixing side supporting shaft 71 toward the main conveyance path 15 is stored.

According to the second modified example, when a pressure is applied to the second guide roller 65 from the sheet S, the fixing side supporting shaft 71 shifts to the inner peripheral side from the main conveyance path 15 in the groove holes 83 against the biasing forces of the coil springs 85, so that it becomes possible to release the pressure. Therefore, the adhesion of the toner to the first guide roller 63 and the second guide roller 65 can be further reduced.

The above embodiment describes the example where the guide member 61 includes the first guide roller 63 and the second guide roller 65; but, the guide member 61 may include the first guide roller 63 only.

The above embodiment describes the example where the first guide roller 63 is maintained at the guide position owing to the weights of the coupling plates 67 and itself; but, the configuration to maintain the first guide roller 63 at the guide position is not to limited to the above embodiment. As with the second modified example, the moving side supporting shaft 73 may be supported in a movable manner along the horizontal direction, and may be biased by a biasing member, such as a coil spring, to the guide position where a part of the first guide roller 63 protrudes in the curved path 15*a* from the inner peripheral side. In this case, when the pressure is applied to the first guide roller 63 from the sheet, the first guide roller 63 is shifted from the curved path 15*a* to the inner peripheral side against the biasing force of the coil spring.

Although the present disclosure has been described with respect to specific embodiments, the present disclosure is not limited to the embodiments described above. Those skilled in the art will be able to modify the above embodiments without departing from the scope and spirit of the present disclosure.

The invention claimed is:

1. An image forming apparatus comprising:

a fixing device which fixes a toner image on a sheet;

a conveyance rollers pair which conveys the sheet on which the toner image is fixed by the fixing device;

a curved path provided between the fixing device and the conveyance rollers pair, the sheet being conveyed along the curved path with a toner image fixed surface facing an inner peripheral side of the curved path; and a first guide roller shiftable between a guide position protruding in the curved path from the inner peripheral side and the inner peripheral side, wherein when the sheet is conveyed along the curved path, the first guide roller is pushed by the sheet while rotating following the sheet and then is shifted from the guide position to the inner peripheral side.

2. The image forming apparatus according to claim 1, wherein the first guide roller is supported by a lower end portion of a coupling plate in a rotatable manner, the coupling plate being supported by a supporting shaft in a turnable manner, and the first guide roller is maintained at the guide position by its weight.

3. The image forming apparatus according to claim 2, further comprising:

a restriction piece which restricts a turning of the coupling plate toward an outer peripheral side of the curved path.

4. The image forming apparatus according to claim 1, wherein the curved path is curved upward in an arc shape from the fixing device to the conveyance rollers pair.

5. The image forming apparatus according to claim 1, further comprising:

a fixing discharge rollers pair disposed between the fixing device and the first guide roller, wherein the first guide rollers are disposed outside the fixing discharge rollers pair in a width direction of the sheet.

6. The image forming apparatus according to claim 4, wherein a rotational speed of the conveyance rollers pair is faster than a rotational speed of the fixing discharge rollers pair.

7. The image forming apparatus according to claim 2, further comprising:

a second guide roller which is supported by the supporting shaft in a rotatable manner on a downstream side of the first guide roller in a conveyance direction of the sheet and is protruded in the curved path from the inner peripheral side.

8. The image forming apparatus according to claim 7, wherein the first guide roller and the second guide roller are disposed to be shifted in an axial direction of the supporting shaft.

9. The image forming apparatus according to claim 7, wherein the supporting shaft is supported in a shiftable manner to the inner peripheral side.

10. The image forming apparatus according to claim 7, further comprising a duplex printing path branched from the curved path, wherein when a duplex printing is performed, the first guide roller and the second guide roller guide the sheet from the curved path to the duplex printing path.

* * * * *